US005454984A

United States Patent [19]

Graubart et al.

[11] Patent Number: 5,454,984

[45] Date of Patent: Oct. 3, 1995

[54] ALL PURPOSE CLEANING COMPOSITION

[75] Inventors: Beth T. G. Graubart, Mahwah; Allan L. Streit, Rivervale; Ernest J. Sachs, Carlstadt; Carol A. Beronio, Bloomfield, all of N.J.

[73] Assignee: Reckitt & Colman Inc., Montvale, N.J.

[21] Appl. No.: 376,682

[22] Filed: Jan. 23, 1995

Related U.S. Application Data

[63] Continuation of Ser. No. 49,884, Apr. 19, 1993, abandoned.

[51] Int. Cl.[6] ..... C11D 1/62; C11D 1/72; C11D 1/75; C11D 1/835

[52] U.S. Cl. ..... 252/547; 252/548; 252/153; 252/174.21; 252/174.22

[58] Field of Search ..... 252/547, 548, 252/153, 174.27, 174.22

[56] References Cited

U.S. PATENT DOCUMENTS

| | | | |
|---|---|---|---|
| H269 | 5/1987 | Malik | 422/37 |
| Re. 32,300 | 12/1986 | Gorman et al. | 514/635 |
| 3,469,109 | 2/1970 | Walker et al. | 252/106 |
| 3,539,520 | 11/1970 | Cantor et al. | 252/106 |
| 4,065,409 | 12/1977 | Flanagan | 253/528 |
| 4,158,644 | 6/1979 | Hammerel | 252/547 |
| 4,174,304 | 11/1979 | Flanagan | 252/524 |
| 4,203,872 | 5/1980 | Flanagan | 252/542 |
| 4,264,479 | 4/1981 | Flanagan | 252/524 |
| 4,272,395 | 6/1981 | Wright | 252/106 |
| 4,311,618 | 1/1982 | Schäfer-Burkhard | 252/542 |
| 4,443,364 | 4/1984 | Klinger et al. | 252/547 |
| 4,455,250 | 6/1984 | Frazier | 252/106 |
| 4,576,729 | 3/1986 | Paszek et al. | 252/106 |
| 4,597,887 | 7/1986 | Colodney et al. | 252/106 |
| 4,606,850 | 8/1986 | Malik | 252/528 |
| 4,755,327 | 7/1988 | Bernarducci et al. | 252/547 |
| 4,759,867 | 7/1988 | Choy et al. | 252/143 |
| 4,804,492 | 2/1989 | Bernarducci | 252/106 |
| 4,842,771 | 6/1989 | Rörig et al. | 252/547 |
| 4,992,107 | 2/1991 | Itoku et al. | 134/27 |
| 4,994,199 | 2/1991 | Scardera et al. | 252/106 |
| 5,057,311 | 10/1991 | Kamegal et al. | 424/70 |

FOREIGN PATENT DOCUMENTS 133900A 3/1985 European Pat. Off. .

*Primary Examiner*—Paul Lieberman
*Assistant Examiner*—E. Harriman
*Attorney, Agent, or Firm*—Frederick H. Robin; J. Jeffrey Holloway

[57] ABSTRACT

A synergistic cleaning composition has been discovered comprising an aqueous solution a quaternary ammonium compound component; a nonionic surfactant component; and a glycol ether solvent. Surprisingly, the combination of the quaternary ammonium compound component, the nonionic surfactant component, and glycol ether solvent provides a synergistic effect where the cleaning composition functions with a low level of quaternary ammonium compound component while still maintaining at least one of the following desirable properties, as follows: an acceptable cleaning efficacy; a low level irritation or toxicity profile; and/or a broad spectrum antimicrobial activity.

13 Claims, No Drawings

ALL PURPOSE CLEANING COMPOSITION

This application is a continuation, of application number 08/049884, filed Apr. 19, 1993, now abandoned.

FIELD OF INVENTION

This invention relates to an all purpose cleaner particularly useful for cleaning hard surfaces.

BACKGROUND OF THE INVENTION

It is well known in the art to employ quaternary ammonium compounds in cleaning compositions. Quaternary ammonium compounds are good antimicrobial agents but may produce undue irritation to eyes or skin at levels required to impart germicidal properties. In addition, quaternary ammonium compounds and other types of cationic compounds have been demonstrated, at times, to interfere and reduce the cleaning efficiency of hard surface cleaning compositions.

It would be highly desirable to reduce the level of quaternary ammonium compound(s) in cleaning compositions while still achieving at least one of following characteristics: a broad spectrum antimicrobial activity; an acceptable level of eye or skin irritation; or an acceptable cleaning efficacy.

SUMMARY OF THE INVENTION

A synergistic cleaning composition has been discovered comprising an aqueous solution of about 0.01 to about 10 weight percent of a quaternary ammonium compound component; about 0.1 to about 10 weight percent of a nonionic surfactant component; and about 3.5 to about 10 weight percent of a glycol ether solvent, said weight percentages based on the total weight of the composition.

A novel method for the cleaning of particles of soil from hard surfaces has also been discovered comprising the steps of preparing a cleaning composition as described above; diluting the composition with up to about 500 parts by weight water; and contacting the diluted cleaning composition with a hard surface thereby removing soil particles.

Surprisingly, the combination of the quaternary ammonium compound component, the nonionic surfactant component, and glycol ether solvent employed within the stated amounts has been found to provide a synergistic effect. This cleaning composition functions with a low level of quaternary ammonium compound component while still maintaining at least one of the following desirable properties: an acceptable cleaning efficacy; an acceptable level irritation or toxicity profile; and/or a broad spectrum antimicrobial activity. Preferably, all three of these desirable properties are achieved.

DETAILED DESCRIPTION

Generally any of the broad class of quaternary ammonium compounds may be used as the quaternary ammonium compound component in this composition. Preferably more than one quaternary ammonium compound is employed to assist in providing a broader spectrum antimicrobial efficacy. Useful quaternary ammonium compounds include, for example, those quaternary ammonium compounds represented by the following structural formula below:

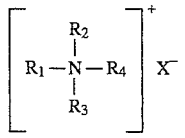

wherein $R_1$, $R_2$, $R_3$, and $R_4$ and X may be described in three general groups, as provided below.

In a first group of preferred quaternary ammonium compounds, $R_1$ and $R_2$ are $C_1$–$C_7$ alkyl groups (preferably methyl groups); $R_3$ is a benzyl group or a benzyl group substituted with an alkyl group having about 1 to 18 carbon atoms or an alkyl group having about 8 to 20, and preferably 8 to 18, carbon atoms; $R_4$ is a benzyl group or a benzyl group substituted with ah alkyl group having about 1 to 18 carbon atoms, $R_4$ is a benzyl group or a benzyl group substituted with an alkyl group having about 1 to 18 carbon atoms or an alkyl group having about 8 to 20, and preferably 8 to 18 carbon atoms; and X is a halide (preferably a chloride or bromide).

In a second group of preferred quaternary compounds, $R_1$, $R_2$ and $R_3$ are $C_1$–$C_7$ alkyl (preferably methyl groups); $R_4$ is an alkyl, an alkyl substituted benzyl, or a phenyl-substituted alkyl group having a total of from about 8 to 20, and preferably 8 to 18 carbon atoms; and X is a halide (preferably a chloride or bromide).

In a third group of preferred quaternary ammonium compounds, $R_1$ is an alkyl, an alkyl substituted benzyl, or a phenyl substituted alkyl group having a total of from about 10 to 20, and preferably from 12 to 16 carbon atoms; $R_2$ is a $C_1$–$C_7$ alkyl (preferably a methyl group); $R_3$ is $[—CH_2CH_2O—]_xH$; and $R_4$ $[—CH_2CH_2O—]_yH$, with the sum of x+y varying between about 2 and 50 (preferably between 2 and 5).

More preferably, the quaternary ammonium compound component is a combination of two or more of the following: dioctyl dimethyl ammonium chloride, octyl decyl dimethyl ammonium chloride, didecyl dimethyl ammonium chloride, ($C_{12}$–$C_{18}$) n-alkyl dimethyl benzyl ammonium chloride, ($C_{12}$–$C_{14}$) n-alkyl dimethyl ethylbenzyl ammonium chloride, and dimethyl (difatty) ammonium chloride.

Most preferably employed as the quaternary ammonium compound component is a dual quaternary system of dialkyl dimethyl ammonium chloride and alkyl dimethyl benzyl ammonium chloride where the ratio of dialkyl dimethyl ammonium chloride to alkyl dimethyl benzyl ammonium chloride may be widely varied. Preferably, the ratio of the dual system components employed is from about 13 to about 30 parts dialkyl dimethyl ammonium chloride to about 87 to about 70 parts alkyl dimethyl benzyl ammonium chloride, based on the total of 100 parts of quaternary ammonium compound component used in the composition. More preferably, the ratio is from 20 to 25 parts dialkyl dimethyl ammonium chloride to 80 to 75 parts alkyl dimethyl benzyl ammonium chloride.

Quaternary ammonium compounds are well known and available commercially from a number of suppliers. For example, dialkyl dimethyl ammonium chloride is available in an approximately 50% active ingredient solution as BARDAC™-2050 quaternary ammonium compound from Lonza, Inc. (Fairlawn, N.J.) and BIO-DAC™ 50–20 quaternary ammonium compound from Bio-Labs (Decatur, Ga.) both of which are mixtures of approximately 25% octyldecyl dimethyl ammonium chloride, about 10% dioctyl dimethyl ammonium chloride, about 15% didecyl dimethyl ammonium chloride in a solvent solution containing about 10–20% ethyl alcohol and 30–40% water. Also, for example, alkyl dimethyl benzyl ammonium chloride is available in an approximately 80% active ingredient solution as BTC™ 8358 from Stepan Co. (Northfield, Ill.); BIO-QUAT™ 80–28RX from BioLab; and BARQUAT™ MB80–10 from Lonza, each of which have an alkyl distribution of approximately $C_{14}$ (50%); $C_{12}$ (40%) and $C_{16}$ (10%) and diluents of ethyl alcohol (10%) and water (10%).

Preferably the quaternary ammonium compound component is employed in such amounts that the composition is provided with antimicrobial activity without exhibiting an undue irritation to eyes or skin. Higher amounts of quaternary compound(s) than those amounts taught herein may be used, however, one advantage of this composition is that the synergistic combination of the ingredients allows for the quaternary compound component to be used in an unexpectedly low amount.

Preferably, the quaternary ammonium compound component may be employed in an amount ranging from about 0.01 weight percent to about 10 weight percent, more preferably ranging from 0.08 to about 1.10 weight percent, and most preferably ranging from 1.04 to 1.06 weight percent, based on the total weight of the aqueous composition.

Preferred nonionic surfactants that may be employed in the composition are generally water soluble and include one or more of the following: amine oxides, block polymers, alkoxylated alkanolamides, ethoxylated alcohols, and ethoxylated alkyl phenols, and the like, with a more complete listing of commercially available nonionic surfactants found under these class listings the "Chemical Classification" section of *McCutcheon's Emulsifier & Detergents North American Edition,* 1991.

More preferred nonionic surfactants may be listed under three general groups of compounds: (1) amine oxide compounds; (2) ethoxylated phenols and ethoxylated alcohols formed by condensation of either an alkyl phenol or an aliphatic alcohol with sufficient ethylene oxide to produce a compound having a polyoxyethylene, i.e., a chain composed of recurring ($—OCH_2CH_2—$) groups; and (3) alkoxylated alkanolamides, each of which are described more particularly hereinafter.

The first group of nonionic surfactants preferred, amine oxides, may be defined as one or more of the following of the four general classes:

(1) Alkyl di(lower alkyl) amine oxides in which the alkyl group has about 10–20, and preferably 12–16 carbon atoms, and can be straight or branched chain, saturated or unsaturated. The lower alkyl groups include between 1 and 7 carbon atoms. Examples include lauryl dimethyl amine oxide, myristyl dimethyl amine oxide, and those in which the alkyl group is a mixture of different chain lengths, such as lauryl myristyl dimethyl amine oxide, dimethyl cocoamine oxide, dimethyl (hydrogenated tallow) amine oxide, and myristyl/palmityl dimethyl amine oxide;

(2) Alkyl di(hydroxy lower alkyl) amine oxides in which the alkyl group has about 10–20, and preferably 12–16 carbon atoms, and can be straight or branched chain, saturated or unsaturated. Examples are bis(2-hydroxyethyl) cocoamine oxide, bis(2-hydroxyethyl tallowamine oxide; and bis(2-hydroxyethyl) stearylamine oxide);

(3) Alkylamidopropyl di(lower alkyl) amine oxides in which the alkyl group has about 10–20, and preferably 12–16 carbon atoms, and can be straight or branched chain, saturated or unsaturated. Examples are cocoamidopropyl dimethyl amine oxide and tallowamidopropyl dimethyl amine oxide; and (4) Alkylmorpholine oxides in which the alkyl group has about 10–20, and preferably 12–16 carbon atoms, and can be straight or branched chain, saturated or unsaturated.

The second group of preferred nonionic surfactants, ethoxylated alcohols and ethoxylated phenols, are well known and may be formed by condensation of an alkyl phenol, an aliphatic alcohol, or mixtures thereof, with sufficient ethylene oxide to produce a compound having a polyoxyethylene. Preferably the number of ethylene oxide units are present in an amount sufficient to insure solubility of the compound in the aqueous composition of this invention or in any dilution thereof. More preferably the ethoxylated alcohols and phenols are produced by condensation of about 4–16 (more preferably 8–13), moles of ethylene oxide with 1 mole of the parent compound (i.e. alkyl phenol or aliphatic alcohol). As known to those skilled in the art, the number of moles of ethylene oxide which are condensed with one mole of parent compound depends upon the molecular weight of the hydrophobic portion of the condensation product. The parent compounds that may be combined with the ethylene oxide may include one or more of the following:

(1) an alkyl phenol having about 1–15, and preferably 7–10, carbon atoms (saturated or unsaturated) in the alkyl group [including phenol, methyl phenol (cresol), ethyl phenol, hexyl phenol, octyl phenol, dicylphenol, nonylphenol, dodecylphenol, and the like]; and (2) a primary, tertiary, or secondary aliphatic alcohol having about 10–20, and preferably 11–15, carbon atoms, (including decyl alcohol, dodecyl alcohol, tridecyl alcohol, hexadecyl alcohol, octadecyl alcohol, and the like).

The third group of preferred nonionic surfactants, alkoxylated alkanolamides, are $C_8$–$C_{24}$ alkyl di($C_2$–$C_3$ alkanol amides), as represented by the following formula:

$$R_5\text{-CO-NH-}R_6\text{-OH}$$

wherein $R_5$ is a branched or straight chain $C_8$–$C_{24}$ alkyl radical, preferably a $C_{10}$–$C_{16}$ alkyl radical and more preferably a $C_{12}$–$C_{14}$ alkyl radical, and $R_6$ is a $C_1$–$C_4$ alkyl radical, preferably an ethyl radical.

The nonionic surfactant is preferably employed in an amount ranging from about 0.1 to 10 weight percent, more preferably from 4 to 8 weight percent, and most preferably from 6 to 7 weight percent, based on the total weight of the composition.

More preferably, the nonionic surfactant component suitable for this invention is a combination of an ethoxylated alcohol compound, an alkoxylated alkanolamide compound, and an alkyl di(lower alkyl) amine oxides in which the alkyl group has 10–20 carbon atoms. Most preferably, the nonionic surfactant component is a combination of a secondary alcohol ethoxylate, an ethoxylated alkanolamide, and an alkyl di(lower alkyl) amine oxide in which the alkyl group has 12–16 carbon atoms.

The ratio of each of the preferred three nonionic surfactant compounds used as the surfactant component may vary widely. Preferably, when this preferred combination of nonionic surfactants is employed, the ratio is as follows: ethoxylated alcohol ranging from about 1 to about 95 parts: alkoxylated alkanolamide ranging from about 98.99 to about 1 parts: amide oxide ranging from about 0.01 to about 4.5 parts amine oxide, based on 100 parts nonionic surfactant. More preferably, the ratio of preferred surfactants is: ethoxylated alcohol ranging from 70 to 90 parts: alkoxylated alkanolamide ranging from 29 to 10 parts: amide oxide ranging from 1 to 4 parts. Most preferably the ratio of preferred surfactants is: ethoxylated alcohol ranging from 78 to 82 parts: alkoxylated alkanolamide ranging from 19 to 15 parts: amide oxide ranging from 3 to 4 parts.

Nonionic surfactant compounds are widely available commercially. For example TERGITOL™ 15 S-9 alkoxypolyethylenoxyethanol as represented by the formula $C_{11-15}H_{23-31}O(CH_2CH_2O)_xH$ having a degree of ethoxylation on a mole/mole average of 8.9 (67 weight % of ethoxylation) and a HLB (Hydrophile-Lipophile Balance) number calculated as about 13.3 is available from by Union Carbide (Danbury, Conn.). NINOL™ 1301 ethoxylated alkanolamide is available from the Stepan Co. (Northfield, Ill.), as represented by the formula:

$$R_7\overset{\overset{\displaystyle O}{\|}}{C}NHCH_2CH_2O(CH_2CH_2O)_5H$$

(where the $R_7$ represents a predominantly $C_{12-14}$ alkyl chain) having substantially no free amine and no free fatty acid. VAROX™ 270 is a lauric/myristic dimethyl amine (CTFA name lauramine oxide), as represented by the formula:

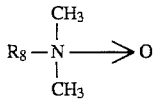

where $R_8$ is a lauric (having less than 1% free amine), as available from Sherex, Witco Corp. (New York, N.Y.).

Preferred as solvents in this invention are the glycol ethers having the general structure $R_9$-O-$R_{10}$-OH, wherein $R_9$ is an alkoxy of 1 to 20 carbon atoms, or aryloxy of at least 6 carbon atoms, and $R_{10}$ is an ether condensate of propylene glycol and/or ethylene glycol having from one to ten glycol monomer units. Preferred are glycol ethers having one to five glycol monomer units. These are $C_3$–$C_{20}$ glycol ethers. Examples of more preferred solvents include propylene glycol methyl ether, dipropylene glycol methyl ether, tripropylene glycol methyl ether, propylene glycol isobutyl ether, ethylene glycol methyl ether, ethylene glycol ethyl ether, ethylene glycol butyl ether, diethylene glycol phenyl ether, propylene glycol phenol ether, and mixtures thereof. More preferably employed as the solvent is one or more of the group consisting of ethylene glycol n-butyl ether, diethylene glycol n-butyl ether, and mixtures thereof. Most preferably, the solvent is a diethylene glycol n-butyl ether [also recognized by the names 2-(2-butoxyethoxy)ethanol, butoxydiglycol and diethylene glycol monobutyl ether] having the formula: $C_4H9OCH_2CH_2OCH_2CH_2OH$, as available for example in the DOWANOL™ glycol ether series (most preferably as DOWANOL DB diethylene glycol n-butyl ether) available from The Dow Chemical Company, Midland Mich., or as Butyl CARBITOL™ from Union Carbide.

The glycol ether solvent is preferably employed in an amount ranging from about 3.5 to about 10 weight percent, based on the total weight of the composition. More preferably, the glycol ether component is employed in an amount ranging from 4 to about 8 weight percent, and most preferably, from 4.5 to 5.5 weight percent.

In addition to the quaternary ammonium compound component, nonionic surfactant component, and glycol ether solvent ingredients described as active ingredients, the composition may also be formulated to include other optional ingredients, as well known to those skilled in the art. For example optional ingredients that may employed include, but are not limited to, builders, chelating and sequestering agents, dyes, fragrances, buffers, acids, and so on.

Examples of builders that may be used in the formulation include, but are not limited to, water soluble sodium, potassium or ammonium salt of carbonate, bicarbonate, polyphosphate, polycarboxylate or aminopolycarboxylate, including, for example, sodium carbonate, sodium bicarbonate, potassium tripolyphosphate, potassium pyrophosphate, sodium citrate dihydrate, trisodium nitrilotriacetate, tetrasodium ethylenediamine tetraacetate, and mixtures thereof, and so on, all widely commercially available. A particularly preferred builder component is a combination of sodium citrate and triethanolamine.

Chelating agents (also commonly referred to as sequestering agents) that may be used in the composition are well known to those skilled in the art and include, but are not limited to, sodium gluconate, gluconic acid, citric acid, sorbitol, tartaric acid, anthranilic acid, polyacrylic acid, sodium hexameta phosphate, mixed alkyl-diaminepolyacetic acid (as sodium salts and alkanolamines), tetrasodium ethylenediamine tetraacetate, and so on, as listed, for example in *McCutcheon's Emulsifiers & Detergents North American Edition,* 1991, pp. 31–40. Particularly preferred as a chelating agent is tetrasodium ethylenediamine tetraacetate.

In addition to the active and optional ingredients, the inventive composition contains water. As set forth above, the amounts of the ingredients are provided such that a substantial portion of the balance of the composition is water, although the composition as set forth is generally considered a concentrate which is typically diluted prior to usage, as discussed in more detail hereinafter. The composition may also be prepared in a more concentrated form by omitting water, as known to those skilled in the art. Active ingredient weight percentages omitting water, may be easily calculated from those weight percentages as previously set forth (which have included the water balance percentage).

Generally, the composition is typically diluted prior to common usage. The amount of dilution is generally dependent upon the properties desired. The composition is particularly well-suited for hard surfaces although it may be used widely for other cleaning jobs. For typical usage as a hard surface cleaner, the aqueous composition is diluted prior to usage with water in an amount up to about 1:500, more preferably up to about 1:100, and most preferably, for ease in usage, up to about 1:64 (aqueous composition: water).

More particularly, as known by those skilled in the art, antimicrobial activity effectiveness may include a sanitizing, disinfecting, and/or virocidal reduction of microorganisms, such as, for example, bacteria, viruses, fungi, and the like. The antimicrobial efficacy can be conveniently determined in accordance with the Association of Official Analytical Chemists (AOAC) Use-Dilution Test as described in the *Official Method of Analysis of the Association of Official Analytical Chemists,* 13th Edition, Washington, D.C., page 5. More preferably, the inventive composition provides an efficacy against (substantially destroying) both gram positive microorganisms such as Staphylococcus auresus and gram negative microorganisms such as *Salmonella choleraesuis* when used either full strength or at use concentrations as described previously.

As known to those skilled in the art, cleaning efficacy may include success in reducing soiled surfaces, such as, for example, particulate soil removal, food soils, grease soils, and so on, and preferably also providing a deodorizing effect. Any number of tests may provide measurement of cleaning efficacy, such as tests devised by ASTM (American Standard Test Methods), Chemical Specialties Manufacturers Association (CSMA), and Shell Oil Company.

An evaluation of the level of irritation to eyes when accidentally exposed to the composition by spillage or splashing or to skin caused by exposure to the composition may be measured by any number of techniques, such as, the well known Draize Test and Repeated Insult Patch Test (RIPT). An acceptable level of irritation may take into account the usage and concentration levels of the composition, with higher concentrations naturally having a tendency to increase irritation to eyes or skin. As diluted for normal usage, as defined previously, preferably the cleaning composition provides an acceptable irritation, as described in more detail in the examples hereinafter.

In addition to providing advantages already described, the cleaning composition is formulated such that it is of a moderate foaming propensity. Also, preferably the composition is employed in such a dilution such that a minimal residue is left on the cleaned hard surface once the surface dries.

The compositions of the invention may be prepared by entirely conventional procedures with no particular technique being required.

The following example is provided to illustrate the invention, but by no means is the invention limited to the examples.

EXAMPLE

Two formulations were prepared. Formulation 1 represents the inventive composition. Comparative Formulation 1 represents a comparative composition having a higher concentration of quaternary ammonium compound and an ethanol solvent rather than a glycol ether solvent as employed in the inventive composition.

Formulation 1

| Formulation Components | Chemical Description | Wt. % |
|---|---|---|
| Chelating agent | Tetrasodium Ethylenediamine Tetraacetate (38%) | 1 |
| Builder | Sodium Citrate (100%) | 1 |
| Builder | Triethanolamine (99%) | 2 |
| Nonionic Surfactant | Alkyloxypolyethylenoxyethanol (100%) | 5 |
| Nonionic Surfactant | Lauric/Myristic Dimethyl Amine Oxide (30%) | 0.75 |
| Nonionic Surfactant | Ethoxylated Alkanolamide (100%) | 1 |
| Solvent | Diethylene Glycol Monobutyl Ether (99%) | 5 |
| Quaternary | Dialkyl Dimethyl Ammonium Chloride (50%) | 0.50 |
| Quaternary | Alkyl Dimethyl Benzyl Ammonium Chloride (80%) | 1 |
| Fragrance & Dye | — | 0.45 |
| Tap Water | Diluent | q.s. |

Formulation 1 was prepared by combining the ingredients in the order as listed, as a cold mix, with the exception that the ethoxylated alkanolamide was gradually heated to 105° to 115° F., prior to formulation to provide a substantially free flowing liquid consistency.

Comparative Formulation 1

| Formulation Components | Chemical Description | Wt. % |
|---|---|---|
| Surfactant | Polymeric Polyquaternary Ammonium Chloride | 0.50 |
| Chelating agent | Tetrasodium Ethylenediamine Tetraacetate (38%) | 1 |
| Nonionic Surfactant | $C_{12}$–$C_{15}$ Linear Primary Alcohol Ethoxylate | 2 |
| Nonionic Surfactant | Block copolymer of Propylene Oxide and Ethylene Oxide | 3 |
| Nonionic Surfactant | Block copolymer of Propylene Oxide and Ethylene Oxide | 2 |
| Solvent | Ethanol (95%) | 3 |
| Quaternary | Alkyl Dimethyl Benzyl Ammonium Chloride (80%) | 2.5 |
| Fragrance & Dye | — | 0.24 |
| Deionized Water | Diluent | q.s. |

Example I

Formulation 1 was tested for microorganism efficacy by using the Microbiology AOAC Use-Dilution Test, as outlined in *The Official Methods of Analysis of the Association of Official Analytical Chemists,* 15 ed., 1990, pp. 135–137. As tested, Formulation 1 was diluted to a ratio of 1:64 (cleaning composition:water). By this test method, antimicrobial efficacy was observed, as recorded in TABLE I below.

TABLE I

| Test # | Formulation: Water | Surviving # Organisms/ Originating # Organisms | Type of Organisms |
|---|---|---|---|
| 1 | 1:64 | 1/60 | *S. aureus* (ATCC # 6538) |
| 2 | 1:64 | 0/60 | *S. choleraesuis* (ATCC # 10708) |
| 3 | 1:64 | 0/60 | *S. aureus* (ATCC # 6538) |
| 4 | 1:64 | 1/60 | *S. choleraesuis* (ATCC # 10708) |

The microbiology test results demonstrate the inventive composition kills both gram positive bacteria (*S. aureus*) and gram negative bacteria (*S. choleraesuis*). Thus, this formulation is considered a Broad Spectrum disinfectant.

EXAMPLE II

Cleaning efficacy was measured for Formulation 1 using a Gardner Washability Apparatus, using a standard soil tile at a standard pressure and sponge stroke settings, to determine or quantify the cleaning efficiency of Formulation 1 when tested as diluted to a ratio of 1:64 (cleaning composition:water). In determining the cleaning efficiency, reflectance values were determined using a Gardner Lab Scan Reflectometer for each of the following: a clean unsoiled panel, a soiled panel, and a soiled panel, following Gardner Washability Apparatus scrubbing. Such reflectance values were then employed to calculate % cleaning efficiency according to the following formula:

$$\%\ \text{Cleaning Efficiency} = \frac{Lt - Ls}{Lo - Ls} \times 100\%$$

wherein, Lt= % reflectance average after scrubbing soiled tile Ls= % reflectance average before cleaning soiled tile Lo= % reflectance average original tile before soiling Cleaning efficiency results for Formulation 1 are shown in TABLE II, hereinafter.

TABLE II

| Test # | Formulation: Water | RESULTS | % Soil Removal |
|---|---|---|---|
| 1 | 1:64 | Unsoiled: reflectance = 86<br>Soiled: reflectance = 8.7 | |
| | | $\% \text{ Soil Removal} = \frac{54.8 - 8.7}{86 - 8.7} \times 100\% =$ | 60% |
| 2 | 1:64 | Unsoiled: reflectance = 87<br>Soiled: reflectance = 8.6 | |
| | | $\% \text{ Soil Removal} = \frac{56.3 - 8.6}{87 - 8.6} \times 100\% =$ | 61% |

As shown, the measurement of the cleaning effectiveness of the test samples involved the ability of the cleaning composition to remove the test soil from the test substrate. This was expressed by % Soil Removal. As numerical values for % Soil Removal increase, higher cleaning effectiveness is achieved for the cleaning composition tested. As the results show, the inventive composition showed an excellent cleaning property.

EXAMPLE III

The degree of irritation of Formulation I was measured using the well-known Draize Eye test. Unlike in Examples I and II, Formulation 1 was not diluted prior to testing.

As known to those skilled in the art, the Draize Eye Test measures eye irritation for the grading of severity of ocular lesions, measuring three dimensions: scores obtained for the cornea, iris and conjunctive. For the cornea, after exposure to the composition, (A) the cornea opacity is graded on a scale from 1–4; (B) the area of cornea involved is graded on a scale from 1–4 (where the score=A×B×5 may be a total maximum of 80). For evaluation of the iris, after exposure the composition, (A) the involvement of the iris is graded on a scale of 1–2 (where the score=A×5 may be a total maximum of 10). For a evaluation of the conjunctive, (A) Redness is graded on a scale of 1–3; (B) Chemosis is graded on a scale of 1–4; and (C) Discharge is measured on a scale of 1–3 [where the score= (A+B+C)×2 may be a maximum of 20]. The maximum total score is the sum of all scores obtained for the cornea, iris and conjuctive (a maximum of 110).

The results of the testing of Formulation 1 showed a Draize Test Maximum Mean Total Score (MMTS) of 43.0. In the classification based on the grading of the total score a value of 43 falls within the "Moderately irritating" classification where "To maintain this rating, scores at 7 days must be less than 10 for 3 or more animals and mean 7 day scores must be less than 25, otherwise, raise rating one level."

Within the guidelines of the Environmental Protection Agency (EPA), 40 C.F.R. 162.10 (h)(1), Jul. 3, 1975, based on the Draize Eye Test results, Formulation 1 was determined to have a EPA classification Category II, where corneal involvement or irritation cleared within 8 to 21 days. This category does not require child resistant closure as regulated by the EPA, therefore presenting a marketing advantage of the composition.

COMPARATIVE EXAMPLE I

The procedures of Example I were followed, with the only difference being that Comparative Formulation 1 was substituted. Results indicating the level of antimicrobial activity for the comparative formulation are shown in Table III.

TABLE III

| Test # | Formulation: Water | Surviving # Organisms/ Originating # Organisms | Type of Organisms |
|---|---|---|---|
| 1 | 1:64 | 1/60 | *S. aureus* (ATCC # 6538) |
| 2 | 1:64 | 0/60 | *S. choleraesuis* (ATCC # 10708) |
| 3 | 1:64 | 0/60 | *S. aureus* (ATCC # 6538) |
| 4 | 1:64 | 1/30 | *S. choleraesuis* (ATCC # 10708) |

The results indicate that the comparative formulation has a good microbiology efficacy. This efficacy is believed to be attributed to the high level of quaternary compound present in the formulation.

COMPARATIVE EXAMPLE II

The procedures of Example II were repeated to test the comparative formulation's cleaning efficacy. The only substitution made was the use of Comparative Formulation 1. Results are shown below in Table IV.

TABLE IV

| Test # | Formulation: Water | RESULTS | % Soil Removal |
|---|---|---|---|
| 1 | 1:64 | Unsoiled: reflectance = 86<br>Soiled: reflectance = 8.8 | |
| | | $\% \text{ Soil Removal} = \frac{22.5 - 8.8}{87 - 8.8} \times 100\% =$ | 18% |

The data from Comparative Formulation 1 show that comparison had a cleaning efficacy value of 18% as compared to the 60% and 61% obtained with the inventive formulation (where a higher numerical value % Soil Removal indicates a better cleaning efficacy).

COMPARATIVE EXAMPLE III

An irritation evaluation of the formulation was completed for Comparative Formulation 1, with the only difference from Example III procedures was that Comparative Formulation 1 was substituted.

The results showed that the Comparative Formulation 1 produced current opacity and iritis in ⅓ unwashed eyes both clearing by day 21 and conjunctival irritation in ⅔ unwashed eyes, ⅓ persisting through 21 days. The highest mean Draize Test score was 14.0 on day 1. As analyzed, Comparative Formulation 1 would be assigned as an EPA Category I corrosive, where "Corrosive" indicates a irreversible destruction of ocular tissues or cornea involvement or irritation persisting for more than 21 days" was observed. Thus, the Category I rating of Comparative Formulation 1 would require proper labeling and a child resistant closure cap, as compared to the Category II rating the Formulation 1 which does not require such packaging standards.

This invention has been described in detail with particular reference to preferred embodiments thereof, but it will be understood that variations and modifications can be effected within the spirit and scope of the invention.

What is claimed is:

1. A cleaning composition comprising an aqueous solution of about 0.08 to about 1.10 weight percent of a quaternary ammonium compound component; about 4 to about 8 weight percent of a nonionic surfactant component wherein said nonionic surfactant component is a combination of an alkoxylated alkanolamide, an ethoxylated alcohol, and an alkyl di(lower alkyl) amine oxide in which said alkyl group has from 10 to 20 carbon atoms, wherein said nonionic surfactants are present in a ratio of 1 to about 95 parts ethoxylated alcohol; from about 98.99 to about 1 parts alkoxylated alkanolamide; and from about 0.01 to about 4.5 parts amine oxide, based on 100 parts nonionic surfactant; and about 3.5 to about 10 weight percent of a glycol ether solvent, said weight percentages based on the total weight of the composition.

2. A composition according to claim 1 wherein said nonionic surfactant compounds are present in a ratio of 70 to 90 parts ethoxylated alcohol; from 29 to 10 parts alkoxylated alkanolamide; and from 1 to 4 parts amine oxide, based on 100 parts nonionic surfactant.

3. A composition according to claim 2 wherein said alkoxylated alkanolamide is represented by the following formula:

$$R_5\text{-CO-NH-}R_6\text{-OH}$$

wherein $R_5$ is a branched or straight chain $C_{12}$–$C_{14}$ alkyl radical, and $R_6$ is an ethyl radical; said ethoxylated alcohol is a secondary ethoxylated alcohol, and said amine oxide is an alkyl di(lower alkyl) amine oxide in which the alkyl group has 12–16 carbon atoms, wherein said nonionic surfactants are present in a ratio of 78 to 82 parts secondary ethoxylated alcohol; from 19 to 15 parts alkoxylated alkanolamide; and from 3 to 4 parts amine oxide, based on 100 parts nonionic surfactant.

4. A composition according to claim 3 wherein said glycol ether solvent is represented by a structure $R_9$-O-$R_{10}$-OH, wherein $R_9$ is an alkoxy of 1 to 20 carbon atoms, or aryloxy of at least 6 carbon atoms, and $R_{10}$ is an ether condensate of propylene glycol and/or ethylene glycol having from one to ten glycol monomer units, wherein said glycol ether component is present in an amount ranging from 4 to 8 weight percent, based on the total weight of the aqueous composition.

5. A composition according to claim 4 wherein said glycol ether component is selected from the group consisting of ethylene glycol n-butyl ether, diethylene glycol n-butyl ether, and mixtures thereof.

6. A composition according to claim 5 wherein said glycol ether is a diethylene glycol n-butyl ether present in an amount ranging from 4.5 to 8 weight percent, based on the total weight of the aqueous composition.

7. A composition according to claim 6 wherein said quaternary ammonium component is a combination of a dialkyl dimethyl ammonium chloride and an alkyl dimethyl benzyl ammonium chloride.

8. A composition according to claim 7 wherein the ratio of said quaternary ammonium combination is from 30 to 13 dialkyl dimethyl ammonium chloride and from 70 to 87 alkyl dimethyl benzyl ammonium chloride.

9. A composition according to claim 8 wherein said ratio of said quaternary ammonium combination is from 20 to 25 dialkyl dimethyl ammonium chloride and from 80 to 75 alkyl dimethyl benzyl ammonium chloride.

10. A composition according to claim 9 wherein said quaternary ammonium combination is present in an amount ranging from 1.04 to 1.06 weight percent, based on the total weight of the aqueous composition.

11. A composition according to claim 1 wherein said quaternary ammonium compounds component is present in an amount ranging from 1.04 to 1.06 and comprises more than one quaternary ammonium compound.

12. A composition according to claim 1 wherein:

(1) said quaternary ammonium compound comprises:
  (a) a dialkyl dimethyl ammonium chloride; and
  (b) a alkyl dimethyl benzyl ammonium chloride;

(2) said nonionic surfactant component comprises:
  (c) a secondary alcohol ethoxylate;
  (d) an alkyl di(lower alkyl) amine oxide in which the alkyl group has 12–16 carbon atoms;
  (e) an ethoxylated alkanolamide; and (3) said glycol ether solvent is
  (f) a diethylene glycol monobutyl ether, wherein, said (a) is present in a range 87 to about 70 parts, based on a total sum of 100 parts of said (a)+ (b) and said (b) is present in a range of from 20 to 25 parts, based on a total of 100 parts of said (a) and (b); and the total weight percent of said (a) and (b) together falls within the range of from 1.04 to 1.06 weight percent, based on the total weight of the aqueous composition;

said (c) is present in a range of from 78 to 82 parts, based on a total sum of 100 parts of said (c)+ (d)+ (e) and said (d) is present in a range of from 19 to 15 parts, based said sum of (c)+ (d)+ (e), and said (e) is present in a range of from 3 to 4 parts; and the total weight percent of said (c)+ (d)+ (e) together falls within the range of from 6 to 7 weight percent, based on the total weight of the aqueous composition; and said (f) is present in a range and 4.5 to 5.5 weight percent, based on the total weight of the aqueous composition.

13. A composition according to claim 1 further comprising a fragrance and a dye.

* * * * *